United States Patent [19]

Barten

[11] Patent Number: 5,017,843

[45] Date of Patent: May 21, 1991

[54] COLOR DISPLAY TUBE, DEFLECTION SYSTEM AND ELECTRON GUN

[75] Inventor: Piet G. J. Barten, Eindhoven, Netherlands

[73] Assignee: U.S. Philips Corporation, New York, N.Y.

[21] Appl. No.: 426,518

[22] Filed: Oct. 24, 1989

Related U.S. Application Data

[63] Continuation of Ser. No. 265,631, Nov. 1, 1988, abandoned.

[30] Foreign Application Priority Data

Nov. 4, 1987 [NL] Netherlands ..... 8702631

[51] Int. Cl.[5] ..... H01J 29/70; H01J 29/76

[52] U.S. Cl. ..... 315/368; 313/412

[58] Field of Search ..... 315/368; 313/412

[56] References Cited

U.S. PATENT DOCUMENTS 4,172,309 10/1979 Chiodi ..... 313/409

4,771,216 9/1988 Blacker et al. ..... 315/368

*Primary Examiner*—Theodore M. Blum

*Attorney, Agent, or Firm*—Robert J. Kraus

[57] ABSTRACT

A color display tube having an in-line electron gun 5 and a deflection system 13. The deflection system 13 generates deflection fields having an astigmatic character, such that in a state-of-the-art electron gun overconvergence of the electron beams occurs on the display window. In a color display tube according to the invention, the electron gun 5 is changed such that this overconvergence is compensated by an underconvergence generated in the electron gun. The horizontal spot enlargement factor is reduced by the less astigmatic character of the deflection fields.

14 Claims, 6 Drawing Sheets

COLOR DISPLAY TUBE, DEFLECTION SYSTEM AND ELECTRON GUN

This is a continuation of application Ser. No. 07/265,631, filed Nov. 1, 1988, now abandoned.

BACKGROUND OF THE INVENTION

The invention relates to a colour display tube containing a) an evacuated envelope consisting of a neck, a cone and a display window, b) in the neck an electron gun for generating one central and two outer electron beams whose axes are coplanar, the electron gun comprising a first and a second electrode system, which in operation together form a main lens, and means for applying a focusing voltage and a high voltage to the first and the second electrode system respectively, c) in the electron gun an astigmatic element for astigmatically influencing the electron beams, and d) a deflection system for generating deflection fields for deflecting the electron beams.

A colour display tube of the type described in the first paragraph is known from European Patent Application EP-A-0231964.

In EP-A-0231964 the colour display tube contains a deflection system which during operation generates horizontal and vertical magnetic deflection fields, such that the three electron beams generated by the electron gun and focussed by the main lens on a display screen provided internally on the display window converge over the entire display screen. This leads to a vertical over-focussing of the electron beams on the display screen. This vertical overfocussing can be compensated in part by means of a static astigmatic element; however, in the case of applications which impose ever higher requirements on the definition such as, for example, high resolution colour display tubes, this is sometimes insufficient. In EP-A-0231964 a construction of an electron gun is described which enables a substantially complete correction of the vertical overfocussing by dynamically varying the strength of the astigmatic element with the strength of the deflection fields.

However, on deflection the horizontal spot size increases by a certain spot enlargement factor also, which factor amounts to more than two in the case of 110° colour display tubes. The spot does remain focussed or substantially focussed in the horizontal direction over the entire display screen. In the known construction this horizontal spot enlargement factor is reduced to a very small extent only or not at all. Due to the ever higher requirements imposed on the definition of the display, in particular in the case of high resolution colour display tubes or in the use of colour display tubes for high definition television, it is also important to reduce the, horizontal spot enlargement factor.

SUMMARY OF THE INVENTION

It is an object of the invention to provide a colour display tube of the type described in the first paragraph, in which on deflection the horizontal spot enlargement factor is reduced.

This object is achieved by a colour display tube according to the invention, which is characterized in that an element is incorporated in the electron gun which during operation of the electron gun influences the convergence of the electron beams, a force being exerted on each outer electron beam, the force comprising a component in the plane of the electron beams, perpendicularly to the axis of the relevant outer electron beam and directed away from the central electron beam, and in that the deflection system in operation generates defection fields such that the colour display tube is self-convergent.

A self-convergent colour display tube is to be understood to mean herein a colour display tube in which during operation the three electron beams converge over the entire display screen.

The invention is based on the Following: in the convergence-influencing element the outer electron beams are subjected to a force during operation which deflects these electron beams away from the central electron beam. Moreover, relative to the present state of the art the deflection system has changed such that the colour display lube is self-convergent. Without changing the deflection system underconvergence of the electron beams on the display window would occur. This change of the deflection system leads to magnetic deflection fields having a less astigmatic character. When the astigmatic character of the deflection fields is reduced, the outer electron beams are inflected more towards the central electron beam by the deflection fields. Both effects on the convergence of the electron beams introduced by the invention compensate each other. The object of the invention is attained in that the less astigmatic character of the deflection fields leads to a reduction of the horizontal spot enlargement factor. An additional advantage is that a deflection system for a colour display tube according to the invention can be more readily constructed because the deflection system is more complex as the deflection fields have a more astigmatic character.

Preferably, this element influencing the convergence is the astigmatic element, so that by means of one element both the vertical overfocussing and the convergence of the electron beams can be adjusted, the colour display tube preferably being provided with means for varying the strength of the element influencing the convergence with the strength of the deflection fields.

An embodiment of a colour display tube according to the invention, in which the first electrode system is formed such that during operation a quadripolar field is generated for each of the electron beams in the astigmatic element, is characterized in that for each outer electron beam the centre of its quadripolar field is further removed from the axis of the central electron beam than the axis of said outer electron beam.

Owing to the fact that for each outer electron beam the centre of its quadripolar field does not coincide with its beam axes as is described above, the outer electron beams are subjected to a force which is directed away from the central beam. The astigmatic effect carried out on the electron beams by the astigmatic element hardly changes or not at all.

The object can also be achieved otherwise in an embodiment of a colour display tube according to the invention, in which for each outer electron beam the axis of symmetry of the quadripolar field lies in the plane of the electron beams and forms an angle with the axis of the central electron beam, which angle faces away from the central electron beam.

An embodiment in which both the above-mentioned embodiments are combined is also possible.

In an embodiment of the invention, in which the first electrode system comprises a first electrode, an auxiliary electrode and a second electrode, the second electrode being adjacent to the second electrode system, the auxiliary electrode being between the first and the second electrode and being provided with apertures for passing the electron beams which are suitable for generating the quadripolar fields, and being coupled during operation to means for applying an auxiliary electrode voltage, and at least the second electrode being coupled to means for applying a control voltage, the object can be achieved in a constructive, readily conceivable way when the median points of the apertures through which the outer electron beams pass are further removed from the axis of the central electron beam than the axis of the electron beam passing through the relevant aperture.

The apertures through which the outer electron beams pass may alternatively or in addition form an angle with the central aperture and extend in a direction away from the display window.

The apertures in the auxiliary electrodes may have any shape which leads to the production of quadripolar fields, for example a rectangular, an elongated or a diamond shape, and in general are in a vertical position. Vertical apertures are to be understood to mean herein apertures whose dimension in the plane of the electron beams is smaller than the dimensions in a plane perpendicular to the plane of the electron beams.

preferably, the means for dynamicallY varying the strength of the astigmatic element with the strength of the deflection fields contain means for applying a dynamically varying control voltage to the second electrode which contains a component, for example a parabolic component, which is in synchronism with the horizontal and/or the vertical magnetic deflection field. In this case the forces acting on the electron beams in the first electrode system change to such an extent that the outer beams in the electron gun are subjected to deflections which are in synchronism with the horizontal and/or vertical deflection field. Thus, the underconvergence generated in the electron gun and the compensating overconvergence provided by the deflection system are in synchronism.

A favourable embodiment of the invention is characterized in that the auxiliary electrode is provided with vertical apertures and in that the first electrode system contains an intermediate electrode between the auxiliary electrode and the second electrode, which intermediate electrode has a horizontal aperture or horizontal apertures opposite the apertures in the auxiliary electrode. Thus, it becomes possible to reduce the relative difference between the vertical and the horizontal dimension of the apertures in the auxiliary electrode, such that the horizontal dimension of the apertures can be enlarged and the apertures in the auxiliary electrode can be moved so as to be at a greater distance from the central electron beam without the electron beams passing through these apertures impinging on the edges of the apertures in the auxiliary electrode. This displacement induces a greater effect on the convergence of the electron beams in the first electrode system, thereby making it possible to use more homogeneous magnetic deflection fields having the above-mentioned advantages. In this embodiment the field generated in the first electrode system at the location of the auxiliary electrode partly loses its astigmatic character. In an extreme case the apertures may be such that the astigmatic character of the field generated in the apertures disappears almost completely.

BRIEF DESCRIPTION OF THE DRAWINGS

The invention will not be explained in more detail by means of a few exemplary embodiments and with reference lo a drawing, in which.

The drawing figures are schematic and they are not drawn to scale; corresponding parts in the different embodiments generally bear the same reference numerals.

DESCRIPTION OF THE PREFERRED EMBODIMENTS

Figure 1:
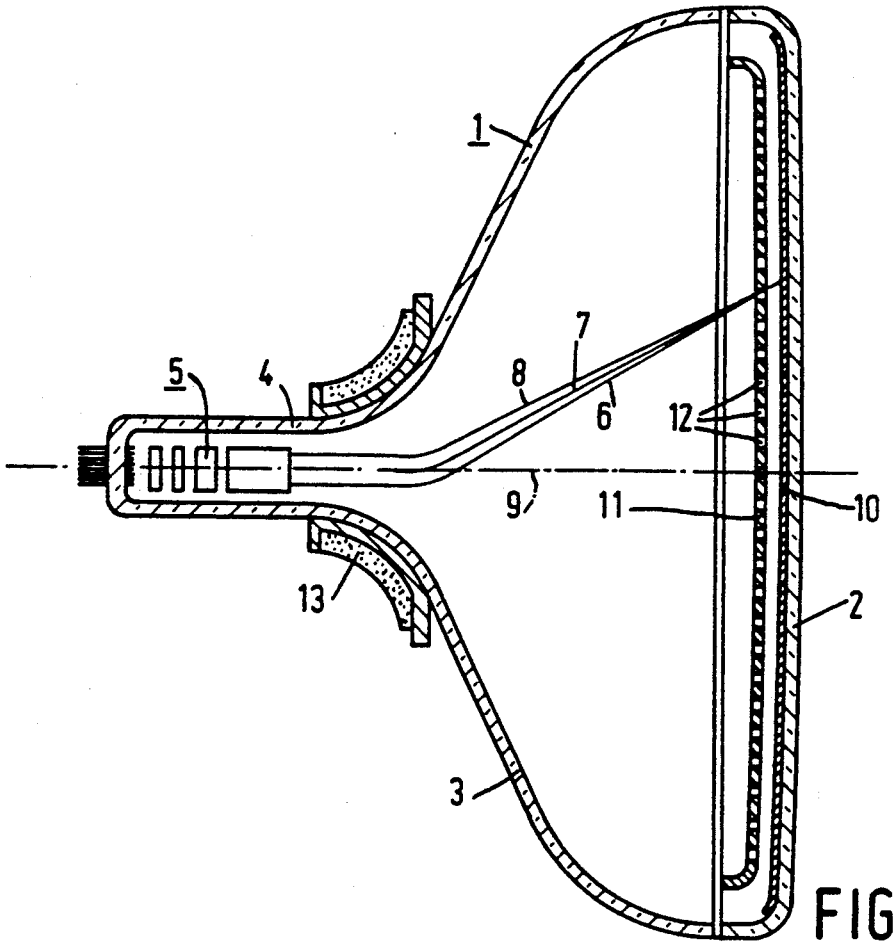
FIG. 1 is a longitudinal sectional view of a colour display tube according to the invention.

FIG. 1 is a sectional view of a colour display tube according to the invention. A glass envelope 1 comprises a display window 2, a cone 3 and a neck 4 which accommodates an electron gun 5 which generates three electron beams 6, 7 and 8 whose axes are located in the plane of the drawing. The axis of the central electron beam 7 coincides in the undeflected condition with the tube axis 9. The display window 2 is provided on the inside with a display screen comprising a large number of triads of phosphor elements. The elements may consist of lines or dots. In the present example linear elements are shown. Each triad contains a line consisting of a green luminescing phosphor, a line consisting of a blue luminescing phosphor and a line consisting of a red luminescing phosphor. The phosphor lines are perpendicular to the plane of the drawing. A shadow mask 11 is positioned in front of the display screen, in which mask a large number of elongated apertures 12 are provided through which pass the electron beams 6, 7 and 8, each electron beam impinging on phosphor lines of only one colour. The three coplanar electron beams are deflected by the deflection coil system 13.

Figure 2:
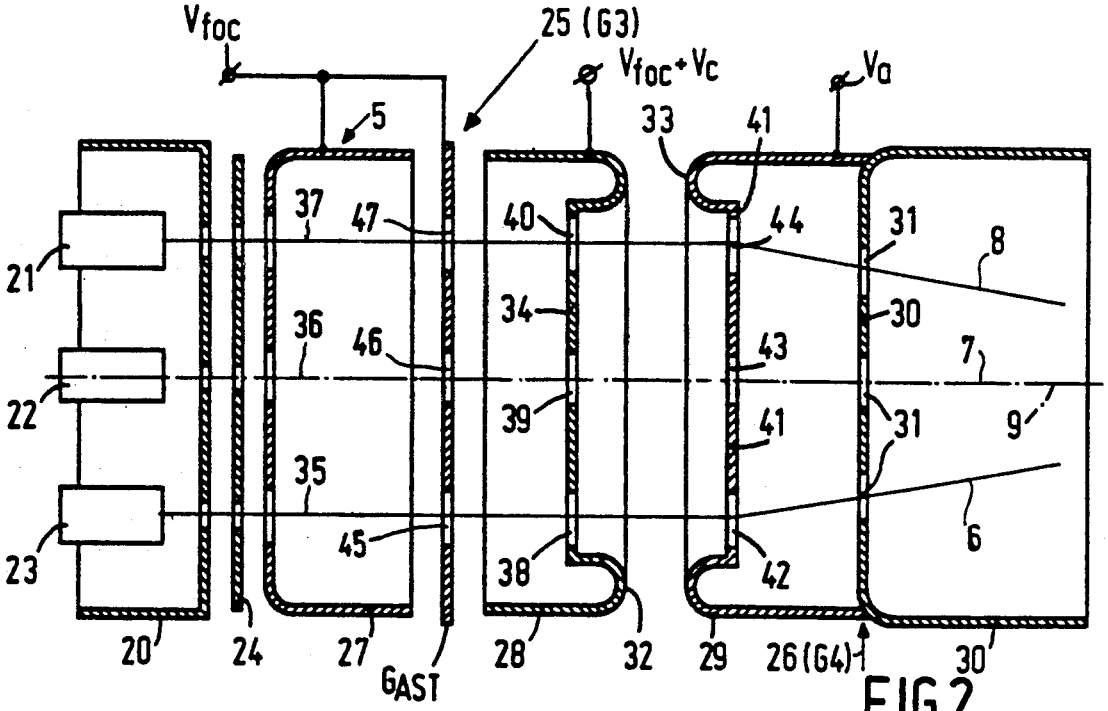
FIG. 2 is a longitudinal sectional view of an electron gun with an auxiliary electrode as is known from the present state of the art.

FIG. 2 is a longitudinal sectional view of an electron system as known from EP-A-0231964. The electron gun contains a common cup-shaped electrode 20 in which three cathodes 21, 22 and 23 are secured, and a common plate-shaped screen grid 24. The three electron beams whose axes are located in one plane are focussed by means of electrode systems 25 (G3) and 26 (G4) which are common for the three electron beams. The electrode system 25 comprises two cup-shaped parts whose open ends face each other, a first electrode 27 and a second electrode 28. The main lens is formed by the first electrode system G3 and the second electrode system, or anode, G4 and may be of a conventional type or of, for example, the polygon type.

Electrode 26 comprises one cup-shaped portion 29 and a centering bush 30, the bottom of which has apertures 31 through which pass the electron beams. The electrode 25 has an outer edge 32 which extends in the direction of the electrode 26, and electrode 26 has an outer edge 33 extending in the direction of the electrode 25. Apertures 38, 39 and 40 are provided in the recessed part 34 which extends perpendicularly to the axes 35, 36 and 37 of the electron beams 6, 7 and 8. Apertures 42, 43 and 44 are provided in the recessed part 41 which extends mainly perpendicularly to the axis 36 of the central electron beam. The recessed parts 34 and 41 form an assembly with the parts 28 and 29, respectively.

Depending on the construction of the gun the electron beams can be inflected towards each other either in the main lens or in the lens field between the electrodes 24 and 27. In the present example the electron beam 6, 7 and 8 are inflected towards each other in the focussing lens.

In this embodiment an astigmatic element is formed in the first electrode system by means of an auxiliary electrode $G_{AST}$ which is provided in an escalated manner as a flat plate having elongated apertures 45, 46 and 47, at some distance from the main lens. The apertures may have any shape which leads to the production of a quadripolar field for the electron beams passing through the apertures, for example a rectangular shape, an oval shape or a diamond shape.

The auxiliary electrode which in the present example is electrically coupled to electrode 27 has means, which are not shown in this drawing, for applying a constant voltage $V_{foc}$. In this example, G3 also has means for applying a control voltage $V_{foc}+V_C$ to electrode 28.

For a more detailed description of the operation and the properties of the electron gun shown in FIG. Z, reference is made to EP-A-0213964.

Figure 3:
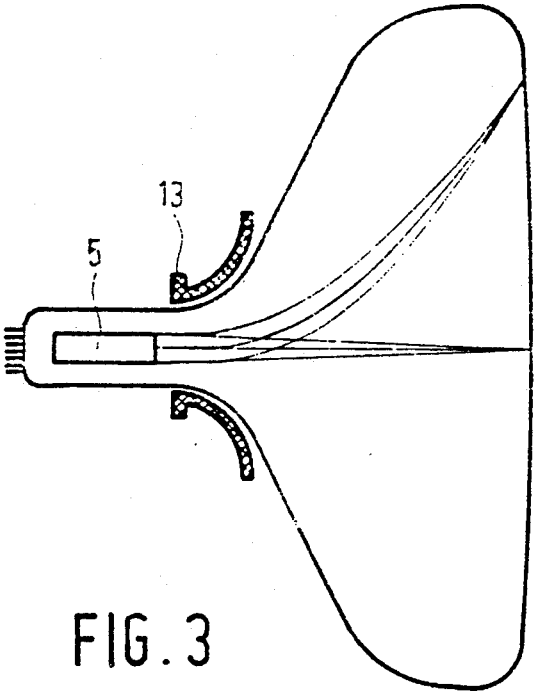
FIGS. 3, 4, 5 and 6 are illustrations by means of schematic sectional views of colour display tubes of some insights which form the basis of the present invention.
Figure 4:
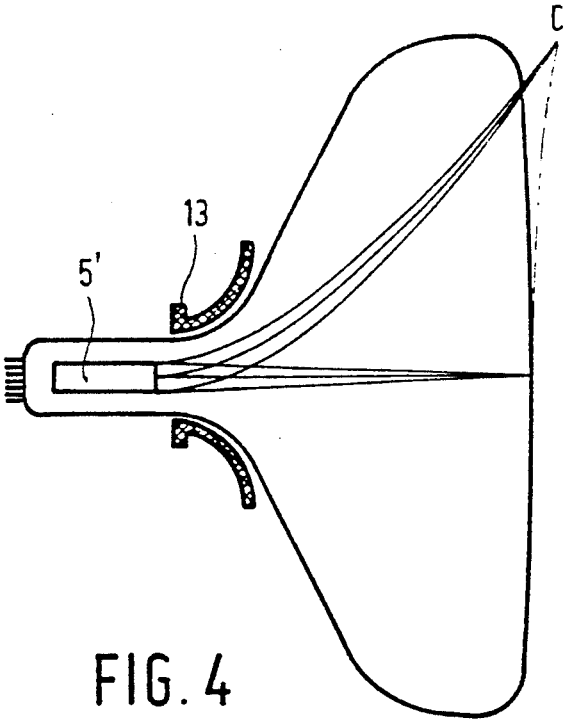
Figure 5:
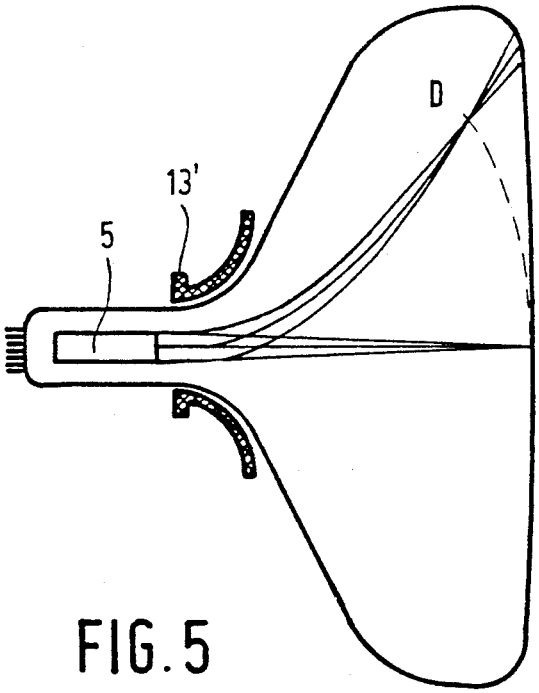
Figure 6:
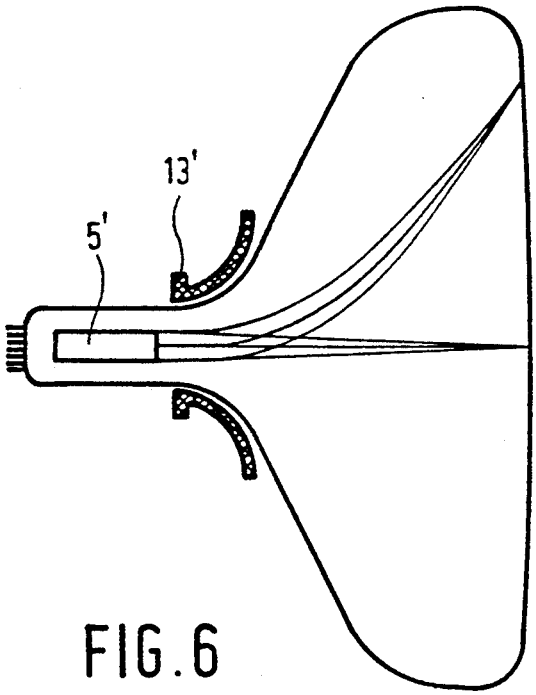

By means of the FIGS. 3 up to and including 6, which are schematic sectional views of colour display tubes, the insight on which the invention is based is explained. FIG. 3 shows a state-of-the-art colour display tube having an electron gun 5 and a deflection system 13. The electron beams converge everywhere on the display window. In FIG. 4 only the electron gun 5 is replaced by an electron gun 5' which is suitable for a colour display tube according to the invention. On deflection underconvergence takes place, i.e. the electron beams intersect beyond the display window in plane C which is represented by dotted lines in FIG. 4. Relative to FIG. 3, in FIG. 5 only the deflection system 13 has been changed to deflection system 13' which generates magnetic fields having a less astigmatic character. On deflection overconvergence now occurs, the electron beams intersect before the display window in plane D. When either effect is considered in itself, underconvergence as well as overconvergence has a negative effect on the display and for this reason they are generally avoided and/or minimized. Finally, FIG. 6 shows a colour display tube according to the invention having an electron gun 5' and a deflection system 13'. The underconvergence induced by the electron gun 5' and the overconvergence induced by the deflection system 13' compensate each other, such that the colour display tube is selfconvergent. Thus, when both measures are combined they do not influence the convergence of the electron beams. The advantage of the invention is that the deflection fields have a less astigmatic character, such that on deflection the horizontal spot enlargement factor is reduced. The effect of the invention is larger as the underconvergence induced in the electron gun is larger. In an extreme case, a deflection system having a minimum astigmatic character can be applied, and consequently, an astigmatic element having a minimum strength can be used.

Figure 7:
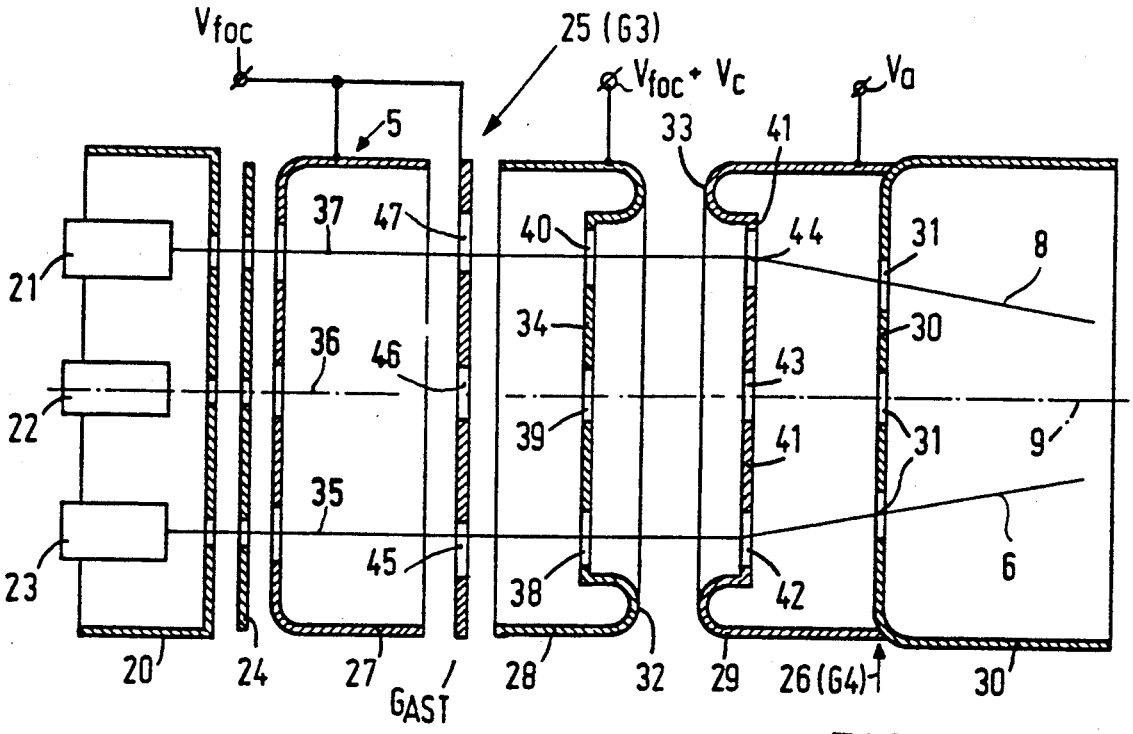
FIG. 7 is a longitudinal sectional view of an electron gun suitable for a colour display tube according to the invention.

FIG. 7 is a longitudinal sectional view of an electron gun which can suitably be used in a colour display tube according to the invention. This electron gun differs from the one shown in FIG. 2 in that relative to the central electron beam 7 the apertures 45 and 47 in the auxiliary electrode $G_{AST}$, through which pass the electron beams 6 and 8, are located further outwards than the axes of the beams 8 and 6, respectively. Due to this, the electron beams 6 and 8 are subjected to a force which is directed away from the central electron beam. The maximum spot enlargement factor, i.e. the ratio of the spot diameter at the edges of the display window and the spot diameter in the centre of the display window is approximately 2.2 for the known 110° colour display tube. For the colour display tube according to the invention this factor bas preferably been reduced to at least 2.0. In this example, the deflection system contains a vertical and a horizontal deflection coil system, each containing two coils which are diametrically arranged relative to each other. Apart from the reduced maximum spot enlargement factor the invention has the additional advantage that the winding diagram for the coil system is simplified such that the coils can be wound in a more readily conceivable way. Even when the deflection system contains auxiliary means for influencing the magnetic deflection fields, for example plates of a soft magnetic material, in general fewer of these means are necessary when the field to be generated is more homogeneous. A further advantage of the less astigmatic character of the deflection fields is that the spot obtains a more circular shape. In the known state of the art the horizontal dimension of the spot at the edges of the display screen is substantially larger than the vertical dimension. In particular for data displays a more uniform spot shape is desired. Too small a vertical dimension may also lead to Moiré effects.

Figure 8:
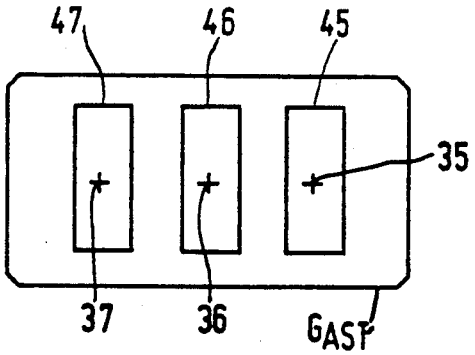
FIG. 8 is a front view of an auxiliary electrode for an electron gun known from the present state of the art.

FIG. 8 shows a front view of the auxiliary electrode of the known electrode system of FIG. 2. In this drawing the axes (35, 36, 37) of the electron beams 6, 7, and 8 are indicated by crosses, and they coincide substantially with the median points of the apertures 45, 46 and 47. The centres of the quadripoles formed in the apertures substantially coincide with the beam axes.

Figure 9:
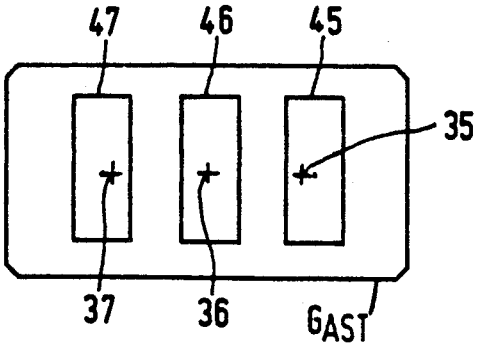
FIG. 9 is a front view of an auxiliary electrode suitable for an electron gun in a colour display tube according to the invention.

FIG. 9 shows a front view of an auxiliary electrode which can suitably be used in an electron gun for a colour display tube according to the invention. In this drawing the median points of the apertures 45 and 47 are indicated by dots. As is shown in the drawing, relative to the central electron beam these median points, which substantially coincide with the centres of the quadripoles formed in the apertures, are located further outwards than the axes 35 and 37 of the beams 6 and 8, respectively. Due to this, the electron beams 6 and 8 are in operation each subject to a force which is directed away from the central beam causing them to be deflected outwardly.

The inventive embodiment shown should not be considered as limitative. The auxiliary electrode $G_{AST}$ may alternatively be disconnected from the electrode 27, in which case the control voltage $V_{foc}+V_C$ may also be applied to the electrode 27.

Figure 10:
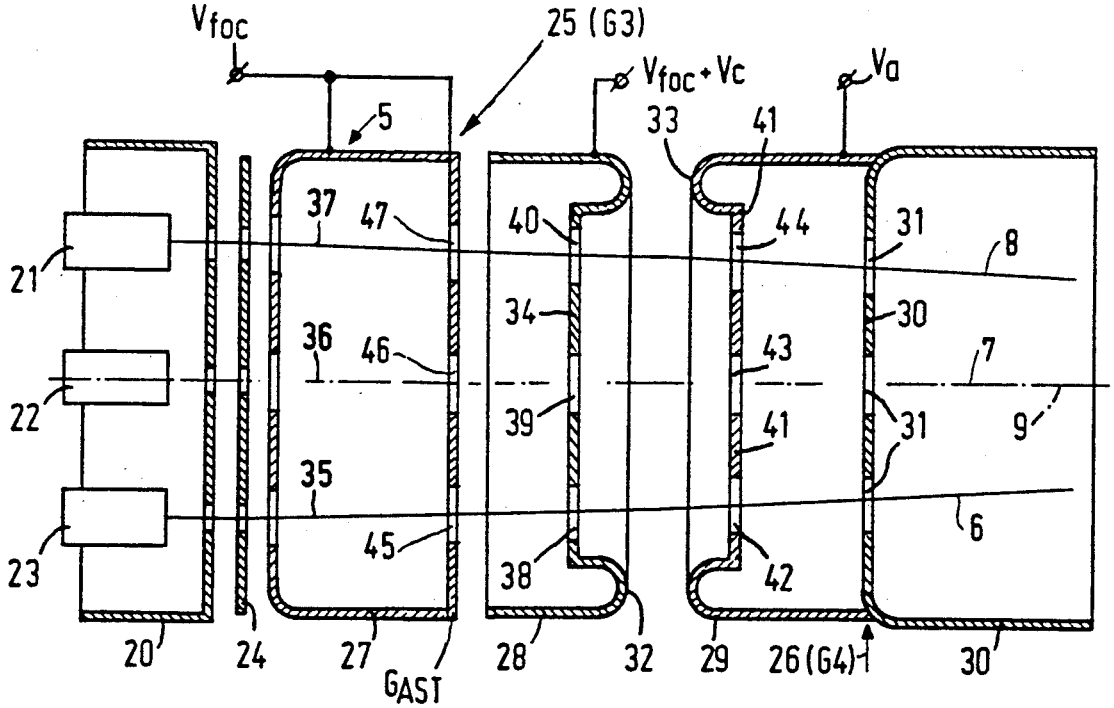
FIG. 10 is a longitudinal sectional view of an electron gun suitable for a colour display tube according to the invention.

FIG. 10 is a sectional view of a subsequent example of an electron gun which can suitably be used in a colour display tube according to the invention. In this example the electron beams between the electrodes 24 and 27 are inflected towards each other.

Figure 11:
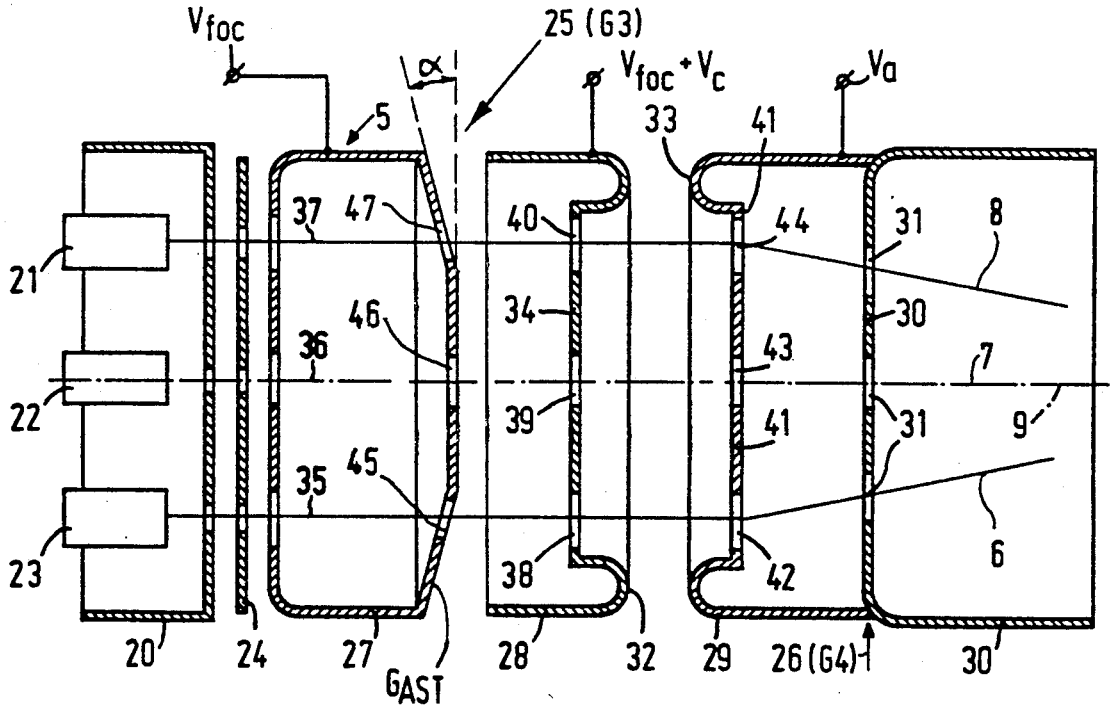
FIG. 11 is a sectional view of an alternative embodiment of an electron gun suitable for a colour display tube according to the invention.

FIG. 11 is a sectional view of another embodiment of an electron gun which can suitably used in a colour display tube according to the invention. This drawing differs from the known electron gun shown in FIG. 2, in that the apertures 45, 46 and 47 are not in one plane but instead the apertures 45 and 47 are at an angle $\alpha$ to the aperture 46, which angle is directed away from the display window. For example, $\alpha$ is approximately 20°.

Figure 12:
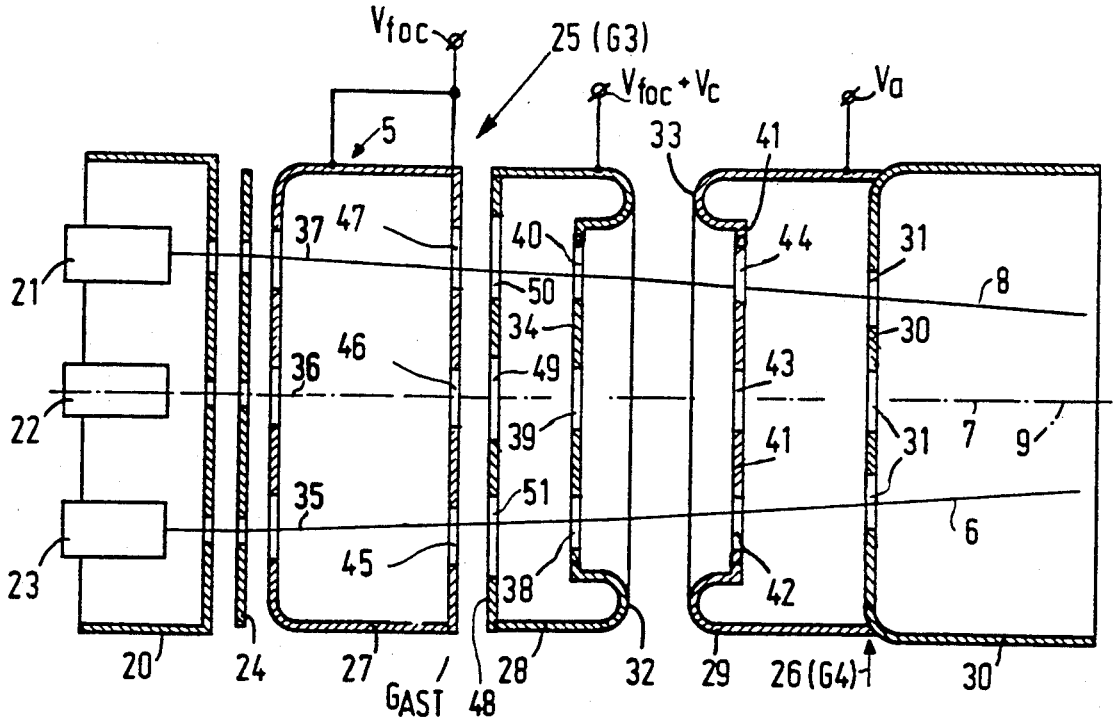
FIG. 12 is a sectional view of a suitable embodiment of an electron gun which can suitably be used in a colour display tube according to the invention.

FIG. 12 shows a favourable embodiment of an electron gun which can suitably be used in a colour display tube according to the invention. This drawing differs from FIG. 10 in that the second electrode 28 has an intermediate electrode 48 which faces the auxiliary electrode, said intermediate electrode having horizontal apertures 49, 50 and 51. These apertures are located opposite the vertical apertures in the auxiliary electrode $G_{AST}$. The horizontal apertures in the intermediate electrode 48 make it possible to reduce the relative difference between the horizontal and the vertical dimensions of the apertures in the auxiliary electrode and, consequently, to situate the apertures in the auxiliary electrode $G_{AST}$ further outwards without the electron beams passing through these apertures impinging on the edges of the apertures in the auxiliary electrode. Thus, a larger effect on the convergence of the electron beams in the first focusing electrode is induced, which enables more homogeneous magnetic deflection fields to be used for compensation, which fields have the abovementioned advantages.

Figure 13:
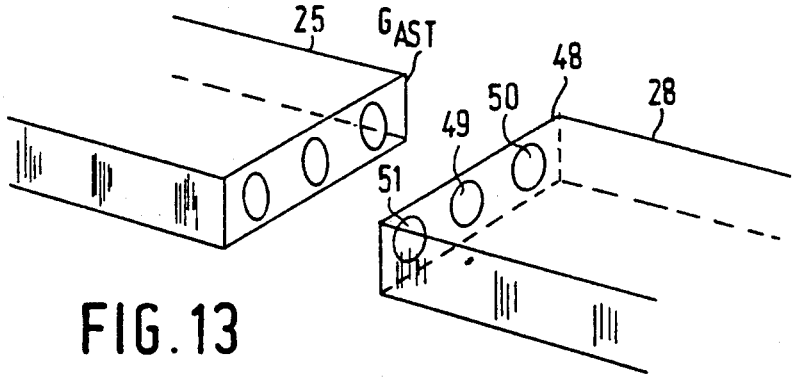
FIG. 13 is a partly perspective view of an auxiliary electrode $G_{AST}$ and an intermediate electrode 48 as shown in FIG. 12.

FIG. 13 shows a partly perspective view of the auxiliary electrode $G_{AST}$ and the intermediate electrode 48, as shown in FIG. 12. The distance between the auxiliary electrode $G_{AST}$ and the intermediate electrode 48 has been enlarged in this drawing in order to depict both electrodes clearly.

Figure 14:
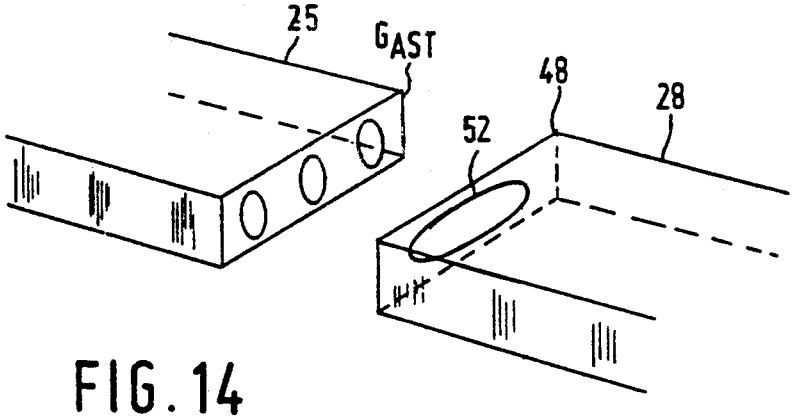
FIG. 14 is a partly perspective view of another embodiment of the auxiliary electrode $G_{AST}$ and the intermediate electrode.

FIG. 14 shows a partly perspective view of an alternative embodiment of the auxiliary electrode and the intermediate electrode. In FIG. 14, the intermediate electrode 48 does not have three different apertures 49, 50 and 51 which are located opposite the three vertical apertures, but instead it has one elongated aperture 52.

Figure 15:
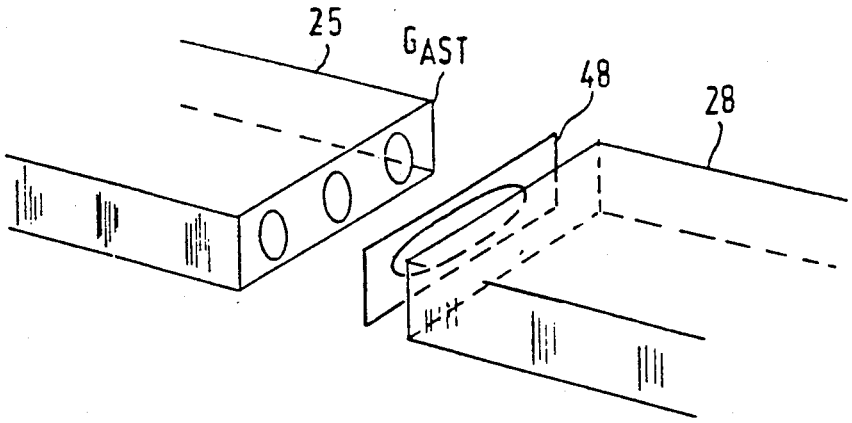
FIG. 15 is a partly perspective view of yet another embodiment of the auxiliary electrode $G_{AST}$ and the intermediate electrode.

In FIGS. 13 and 14 the intermediate electrode 48 is coupled to the electrode 28; FIG. 15 shows an embodiment in which the intermediate electrode 48 decoupled from the electrode 28.

The apertures in the auxiliary electrode $G_{AST}$ and in the intermediate electrode 48 are represented as ovals. However, this should not be considered as limitative. The apertures may also have a rectangular, or a diamondshaped cross-section. The apertures in the intermediate electrode 48 may also he rectangular while the apertures in the auxiliary electrode $G_{AST}$ are oval, or conversely.

Figure 16:
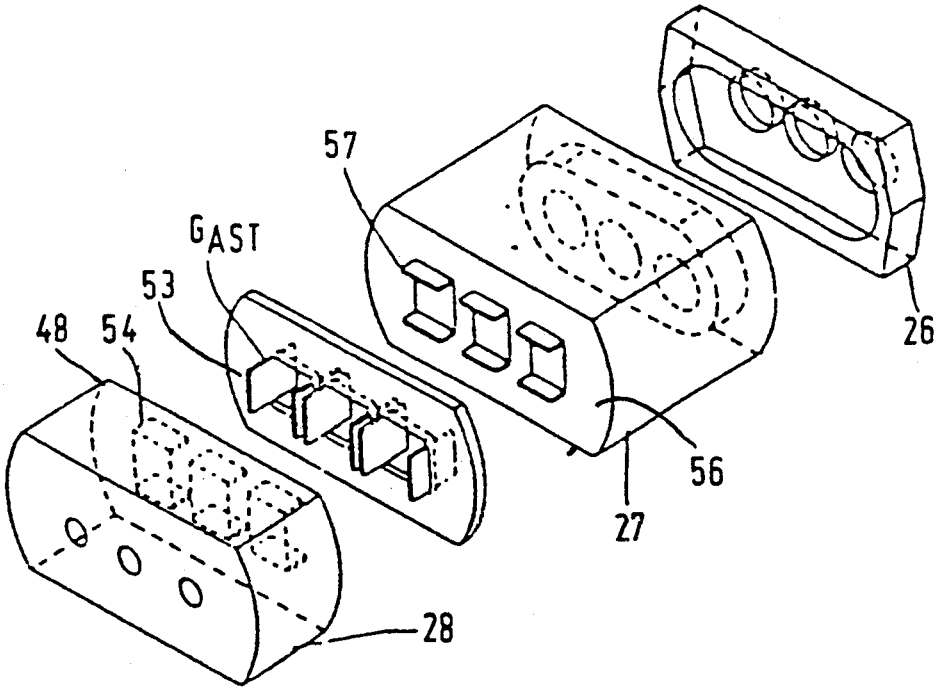
FIG. 16 is a partly perspective view of a detail of another embodiment of an electron gun suitable for a colour display tube according to the invention.

FIG. 16 shows a partly perspective view of a detail of another embodiment of an electron gun which can suitably be used in a colour display tube according to the invention. In this embodiment the apertures in $G_{AST}$ are provided with vertical vanes 53, and the apertures of the intermediate electrode 48 are provided with vanes 54. The electrode 27 is provided with a face 56 which faces the auxiliary electrode and which is provided with apertures having horizontal vanes 57. During operation the astigmatic element is formed by the auxiliary electrode and the vanes 53, 54 and 57.

Finally, by means of the drawings a possible, and used method of constructing a colour display tube according to the invention will be described by way of example. A 110° colour display tube as shown in FIG. 5 is provided with a deflection system 13' which generates deflection fields having an astigmatic character, such that at the edges of the display window an overconvergence 0 occurs, i.e. a distance between the outermost electron beams, for a state-of-the-art electron gun 5. In an experimental arrangement 0 was 6.8 mm. This electron gun 5 is, for example, an electron gun of the common type, as shown in FIG. 2, and is constructed such that during operation the three electron beams are focussed both horizontally and vertically in plane D. In the exPerimental arrangement the swing Z of the control voltage $V_{foc}+V_C$ is approximately 1150 Volts. The swing of the control voltage proved to be smaller in general for a colour display tube according to the invention than for a state-of-the-art colour display tube, which is advantageous since the risks of a short circuit and other problems connected with high voltages are reduced.

Experimentally it is established that a displacement further outwards of 1 mm of the apertures 45 or 47 of the present electron gun and, consequently, of the quadripolar fields associated with the apertures leads per 1000 Volts of control voltage to a displacement P of the outer electron beam(s) passing through these apertures relative to the central electron beam, in the centre of the display screen. The displacement at the edges of the display window can readily be calculated as follows $P_{edge}=P\times X_h$, $X_h$ being the horizontal spot enlargement factor. In the experimental arrangement P was 2.8 mm and $P_{edge}$ was $5.32(X_h=1.9)$.

The displacement of the apertures 45 and 47 which is necessary to compensate the overconvergence caused by the deflection system can be calculated as follows:

a. the overconvergence 0 at the edge of the display window caused by the deflection system is 6.8 mm.
b. Consequently, the distance between an outer and the central electron beam at the edge $0/2=3.4$ mm.
c. A displacement further outwards of 1 mm of the aperture 45 or 47 results in a compensating distance between an outer and the central electron beam at the edge of the display screen of $$P_{edge}\times(Z/1000)=6.12 \text{ mm } (Z=1150 \text{ Volt})$$

d. This gives a displacement further outward of apertures 45 and 47 of $3.4/6.12=0.55$ mm.

As the overconvergence 0 induced by the deflection system increases, the apertures 45 and 47 move further outwards. In this example the displacement is 0.55 mm.

Preferably, the displacement is at least 0.10 mm. In the case of smaller displacements the effect of the invention is only small.

An electron gun of the type shown in FIG. 12 comprises an auxiliary electrode $G_{AST}$ having apertures 45, 46 and 47, and an intermediate electrode 48 having apertures 49, 50 and 51. A displacement outwards of apertures 45 and 47 leads to a positive displacement P of the outer electron beams; a displacement outwards of apertures 51 and 50 leads to a negative displacement P.

Experimentally it was established that a displacement outwards of 1 mm of the apertures 45 and 47 led to a value $P=+5.3$ mm, and a displacement of the apertures 50 and 51 led to a value $P=-3.3$ mm. If both apertures 45 and 47, and 50 and 51 are displaced outwards, the extent of the displacement is, for the given O and z, 0.59 mm. However, the same result can be obtained by a displacement outwards of 0.19 mm of the apertures 45 and 47, and a displacement inwards of 0.19 mm of the apertures 50 and 51. In this way larger overconvergences can be compensated.

It will be clear that within the scope of the present invention many variations are possible to those skilled in the art, for example, a combination of FIGS. 11 and 12, i.e. an electron gun comprising the auxiliary electrode $G_{AST}$ and the intermediate electrode 48, both having "obliquely disposed" apertures, for example, for apertures 45 and 47 being displaced outwards and the apertures 50 and 51 being displaced inwards.

What is claimed is:

1. A self convergent color display tube comprising:

a. an envelope having a display window supporting a luminescent screen;

b. an electron gun disposed in the envelope for producing along respective axes central and first and second outer electron beams directed toward the luminescent screen, said electron gun including electrode means for cooperatively effecting focusing of the individual electron beams and convergence of said electron beams to a common point at said luminescent screen; and c. deflection means for producing a deflection field within the envelope between the electron gun and the luminescent screen for deflecting the electron beams across said screen, said deflection field having an electron beam defocusing astigmatic component of predetermined strength for maintaining said convergence as said electron beams are deflected away from a central region of said screen;

characterized in that;

(1) the deflection means is configured to reduce the strength of the beam defocusing astigmatic component of the deflection field, thereby causing a predetermined overconvergence of the outer electron beams when deflected away from the central region of the screen; and (2) the electron gun includes convergence correction electrode means for responding to a signal applied to the electron gun by dynamically deflecting the outer electron beams away from the central electron beam to the extent necessary to compensate for the predetermined overconvergence in the deflection field.

2. A color display tube as in claim 1 where the convergence correction electrode comprises an astigmatic beam focusing element.

3. A color display tube as in claim 1 or 2 including means for dynamically varying the strength of the convergence correction with variations in the strength of the deflection field.

4. A color display tube as in claim 1 where the convergence correction electrode means is configured to produce a quadrupolar field for each of the electron beams, characterized in that said quadrupolar field for each of the outer electron beams has a center which is further from the axis of the central electron beam than is the axis of the respective outer electron beam.

5. A color display tube as in claim 4 where center of each of the quadrupolar fields for the outer electron beams is disposed at least 0.10 mm from the axis of the respective outer electron beam.

6. A color display tube as in claim 1 where the convergence correction electrode means is configured to produce a quadrupolar field for each of the electron beams, characterized in that said quadrupolar field for each of the outer electron beams is symmetrically disposed around an axis which diverges from the axis of the central electron beam with decreasing distance to the luminescent screen.

7. A color display tube as in claim 1 where the electrode means comprises first and second electrode systems arranged successively along the electron beam axes, said first electrode system including in succession a first electrode, an auxiliary electrode and a second electrode, said auxiliary electrode having central and first and second outer apertures located for passing the respective electron beams and shaped for producing respective quadrupolar fields for the electron beams, characterized in that each of the outer apertures has a center which is further from the axis of the central electron beam than is the axis of the respective outer electron beam.

8. A color display tube as in claim 7 where the outer apertures of the auxiliary electrode lie in respective plains facing outwardly from a center of the luminescent screen.

9. A color display tube as in claim 7 or 8 where the beam axes lie in a common plane and where the apertures in the auxiliary electrode are elongated in a direction substantially perpendicular to said common plane.

10. A color display tube as in claim 7 where the auxiliary electrode is electrically connected to the first electrode.

11. A color display tube as in claim 7 including means for varying the strength of the convergence correction by applying a control voltage to the second electrode which varies synchronously with the deflection field.

12. A color display tube as in claim 10 where the first electrode system includes an intermediate electrode disposed between the auxiliary electrode and the second electrode, said intermediate electrode having at least one aperture which is elongated in a direction substantially parallel to the common plane.

13. A color display tube as in claim 12 where the intermediate electrode is electrically connected to the second electrode.

14. A color display tube as in claim 13 where the intermediate electrode has central and first and second outer apertures which are elongated in a direction substantially parallel to the common plane, each of said outer apertures having a center which is closer to the axis of the central electron beam than is the axis of the respective outer electron beam.

* * * * *